United States Patent [19]

Giaimo

[11] 4,033,453

[45] July 5, 1977

[54] COMBINATION DRINKING CUP AND STORAGE CONTAINER

[76] Inventor: Joseph Giaimo, c/o JMC Tool Co., 845 Fairfield Ave., Kenilworth, N.J. 07033

[22] Filed: June 18, 1976

[21] Appl. No.: 697,424

[52] U.S. Cl. ..... 206/217; 239/33; 215/1 A; 426/85; 426/86; 426/122; 426/123; 128/222

[51] Int. Cl.[2] ..... B65D 77/04; B65D 77/28; B65D 77/36

[58] Field of Search ..... 239/33; 206/217, 218; 229/7 S, 51 S; 215/1 A; 426/79, 85, 86, 122, 123; 128/213, 222, 172; 220/85 K

[56] References Cited

UNITED STATES PATENTS

| | | | |
|---|---|---|---|
| 1,798,339 | 3/1931 | Soulis | 206/217 |
| 2,328,872 | 9/1943 | Yealdhall et al. | 206/217 |
| 2,395,734 | 2/1946 | Georgopoulos | 229/7 S |
| 2,766,796 | 10/1956 | Tupper | 206/217 X |
| 2,915,176 | 12/1959 | O'Neil | 426/86 |
| 3,092,275 | 6/1963 | Brunton et al. | 215/1 C X |
| 3,349,987 | 10/1967 | Weitzner | 215/1 A X |
| 3,780,944 | 12/1973 | Zubalik | 239/33 |
| 3,920,120 | 11/1975 | Shveda | 206/217 |

FOREIGN PATENTS OR APPLICATIONS

| | | | |
|---|---|---|---|
| 1,075,977 | 4/1954 | France | 215/1 A |
| 333,159 | 12/1935 | Italy | 229/51 S |
| 1,194,016 | 6/1970 | United Kingdom | 229/51 S |

*Primary Examiner*—Robert S. Ward, Jr.
*Attorney, Agent, or Firm*—Allen D. Brufsky

[57] ABSTRACT

A drinking cup that has a hollow or false bottom that includes a quantity of medicine or comestible thereon, the bottom adapted to be broken to release the same for introduction into the drinking cup for subsequent mixing with water, a drinking straw forms a part of the rupturable bottom of the cup.

8 Claims, 3 Drawing Figures

COMBINATION DRINKING CUP AND STORAGE CONTAINER

BACKGROUND OF THE INVENTION

This invention relates to a container and drinking cup; more particularly, to a container that releasably confines a quantity of liquid soluble material in a storage compartment below the floor of the container, the compartment adapted to be broken, a portion of which forms a removable straw or liquid stirrer.

The prior art teaches a variety of contaners, for example, as disclosed in U.S. Pat. Nos. 1,798,339, 2,766,796; 3,033,420; 3,262,596; 3,606,068; 3,534,736; 3,915,296; 3,920,120 and others.

SUMMARY OF THE INVENTION

It is accordingly an object of the instant invention to provide for a new and improved container of the aforementioned type. It is another object to provide for a container having an integral straw or stirrer.

It is a further object to provide for the same at relatively little cost thereby making it generally available.

These and other objects and advantages of the invention will become more apparent from the following detailed disclosure and claims and by reference to the accompanying drawings, in which:

Figure 1:
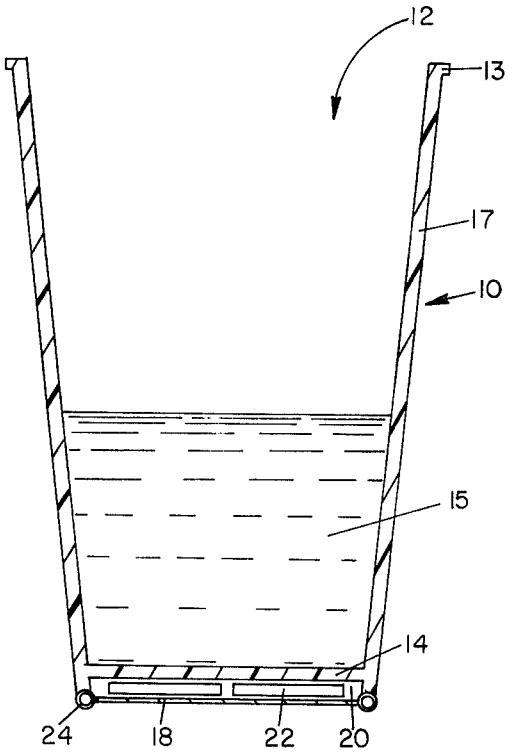
FIG. 1 is a sectional view.
Figure 2:
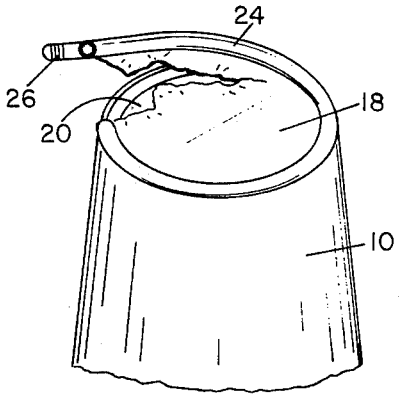
FIG. 2 is a bottom plan.

Broadly speaking, the instant invention includes the provision of a combination disposable drinking tumbler and commestible storage container, comprising a walled receptacle open at one end and adapted to receive a liquid and the commestible therein. A floor adjacent the end opposite the open end, a removable base portion coaxially aligned with the floor and spaced apart therefrom and forming the opposite end of the receptacle, the base portion being in planar alignment with the lower end of the wall, a removable rib communicating between the base and the wall, a quantity of liquid soluble commestible disposed in the space formed between the floor and the base.

DETAILED DISCLOSURE

Referring more particularly to the drawings, there is shown a walled hollow tumbler 10 having an open mouth 12 with a circumferential top edge or rim 13 and a floor portion 14 at the opposite end thereof. The walls 17 of the tumbler 10 are generally circumferentially downwardly tapering and adapted to hold a liquid 15 therein. Disposed a distance below the floor 14 of the tumbler 10 is an integral bottom wall 18, a space or cavity 20 formed therebetween. The wall 17 and floor 14 of the tumbler 10 are constructed of a liquid impermeable material such as a plastic coated paper or plastic. A quantity of liquid soluble commestible 22 is disposed in the cavity 20. The commestible 22 is generally a powdered, granular or readily soluble tablet, such as a medicine, antiacid or the like, the liquid to be admixed therewith generally is water. The bottom wall 18 communicates with the circumferential or annular side wall 17 of the tumbler 10 by means of a removable annular flange, rib or groove 24. The flange 24 in the preferred embodiment is hollow, such as a piece of flexible hollow tubing that when removed can serve as a straw or mixing stick. The flange 24 is removable in contact with the lower end of the wall 17 such as by having a perforate line or stress line therearound that is broken when the flange 24 is pulled away from the wall 17, thereby disengaging the same from the wall 17 and causing the base 18 to drop away from the tumbler 10. Perferably a tab portion 26 is left exposed on one distal end of the flange 24 thereby facilitating the removal of the same.

Figure 3:
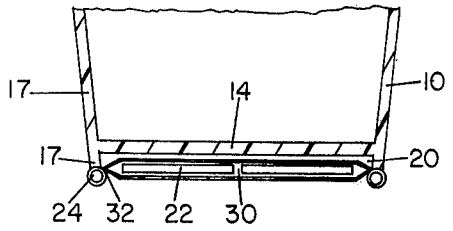
FIG. 3 is similar to FIG. 1 but showing a further embodiment.

If desired, such as is shown in FIG. 3, the commestible 22 may be foil or like wrapped 30, the wrap 30 being integral with a portion of the flange 24 such as having a wall or layer 32 thereof engaging the flange 24, whereby when the flange 24 is pulled away, the wrap 30 tears, thereby exposing the previously protected commestible 22.

Since it is obvious that numerous changes and modifications can be made in the above-described details without departing from the spirit and nature of the invention, it is to be understood that all such changed and modifications are included within the scope of the invention.

I claim:

1. A combination disposable drinking tumbler and commestible storage container comprising a walled receptacle open at one end and adapted to receive a liquid and said commestible therein, a floor adjacent the end opposite said open end, a tearable base portion coaxially aligned with said floor, spaced apart therefrom and forming the opposite end of said receptacle, said base portion being in planar alignment with the lower end of said wall, a removeable rib removeably affixed between said base and said wall, a quantity of liquid soluble commestible disposed in the space formed beween said floor and said base, the removal of said rib causing the tearing of said tearable base portion and the subsequent release of said commestible.

2. The combination as defined in claim 1, wherein said receptacle is annular, said rib being hollow and flexible.

3. The combination as defined in claim 1, wherein said rib is hollow and flexible.

4. The combination as defined in claim 1, wherein said commestible is pre-packaged, at least a portion of said package integrally engaging at least a portion of said rib.

5. The combination as defined in claim 1, wherein said walled receptacle is constructed of a liquid impermeable material.

6. The combination as defined in claim 1, wherein a perforate section communicates between said rub and said walled receptacle.

7. The combination as defined in claim 1, wherein said rib includes an exposed tab portion.

8. The combination as defined in claim 1, wherein a weakened wall zone communicates with said rib.

* * * * *